US005799724A

United States Patent [19]

Cassidy et al.

[11] Patent Number: 5,799,724

[45] Date of Patent: Sep. 1, 1998

[54] TRAPEZOIDAL DEFLECTORS FOR HEAT EXCHANGER TUBES

[75] Inventors: Lee Thomas Cassidy, Beloit, Ohio; Jeffrey A. LaRose, Folsom, Calif.

[73] Assignee: The Babcock & Wilcox Company, New Orleans, La.

[21] Appl. No.: 898,607

[22] Filed: Jul. 22, 1997

[51] Int. Cl.[6] ..... F28F 19/00

[52] U.S. Cl. ..... 165/134.1; 165/183; 122/367.3; 122/DIG. 13

[58] Field of Search ..... 165/134.1, 183, 165/DIG. 524, DIG. 527; 122/367.3, DIG. 13

[56] References Cited

U.S. PATENT DOCUMENTS

| | | | |
|---|---|---|---|
| 2,342,117 | 2/1944 | Brown, Jr. et al. | 122/367.3 X |
| 2,650,802 | 9/1953 | Huet | 122/367.3 X |
| 2,677,532 | 5/1954 | Huet | 122/367.3 X |
| 2,905,447 | 9/1959 | Huet | 257/262.14 |
| 3,279,535 | 10/1966 | Huet | 165/183 |
| 3,476,180 | 11/1969 | Straight, Jr. et al. | 165/172 |
| 4,124,068 | 11/1978 | Thompson | 165/134.1 |
| 4,226,279 | 10/1980 | Eisinger et al. | 165/1 |
| 4,570,703 | 2/1986 | Ringsmuth et al. | 165/162 |
| 4,619,314 | 10/1986 | Shimoda | 165/104.16 |
| 4,655,282 | 4/1987 | Roffelsen | 165/184 |
| 4,691,766 | 9/1987 | Wurz et al. | 165/135 |
| 4,732,585 | 3/1988 | Lerner | 55/90 |
| 4,771,825 | 9/1988 | Chen et al. | 165/151 |
| 4,856,581 | 8/1989 | Santoro | 165/130 |
| 5,318,109 | 6/1994 | Yamada et al. | 165/135 |
| 5,320,071 | 6/1994 | Valenti et al. | 122/18 |
| 5,355,946 | 10/1994 | Wei et al. | 165/172 |

FOREIGN PATENT DOCUMENTS

| | | | |
|---|---|---|---|
| 360245 | 12/1921 | Germany | 165/183 |
| 1285264 | 1/1987 | U.S.S.R. | 122/367.3 |
| 1534247 | 1/1990 | U.S.S.R. | 122/367.3 |

*Primary Examiner*—Allen J. Flanigan

*Attorney, Agent, or Firm*—Daniel S. Kalka; Robert J. Edwards

[57] ABSTRACT

A deflector means having a trapezoidal cross section for reducing erosion of heat exchanger tubes caused by a flowing, particle-laden combustion gas produced in a fossil fuel-fired boiler, and a draft loss reduction means for use in connection with the deflector means. The deflector means preferably is attached to heat exchange tubes in a first row of a tube bank so as to precondition the combustion gas flow. The draft loss reduction means preferably is affixed to heat exchange tubes in a second row of a tube bank in order to reduce draft loss typically caused when combustion gas flows around heat exchange tubes.

6 Claims, 4 Drawing Sheets

TRAPEZOIDAL DEFLECTORS FOR HEAT EXCHANGER TUBES

BACKGROUND OF THE INVENTION

1. Field of the Invention

The present invention relates generally to heat exchanger tubes and more particularly to tubes, or banks of tubes, commonly employed to transfer heat from a hot flue gas produced in the furnace portion of a fossil fuel-fired boiler to water which is circulated through the tubes to produce steam.

2. Description of the Related Art

Combustion of fossil fuels such as pulverized coal, oil and natural gas in the furnace of a boiler produces solid particles which can become entrained in the hot combustion gases that flow through the boiler. Tube erosion has been observed to occur when the particle-laden combustion gases flow past a tube or bank of tubes which is situated in the boiler and is used to collect heat from the combustion gases and to thereby generate steam. The amount of material removed from the outer surface of the boiler tubes by erosion depends upon a number of factors such as the concentration level of the particles in the combustion gases, the hardness of the particles, and the velocity with which they impact the tube surface. The amount of erosion also is dependent upon the resistance of the tube material to cutting action. Erosion reduces the design life of the tube and results in undesirable replacement and maintenance costs. Traditional methods to combat tube erosion include tube shielding (i.e., wrapping sacrificial material around the tube exterior), using baffles and/or barriers to redirect the particulate away from critical areas, reducing the quantity of particles in the combustion gases and reducing the particle impact velocity. The latter two methods involve a change of fuel, load and/or tube arrangement. Selection of a method to reduce erosion has been found to depend upon the economics of making changes, including an evaluation on the equipment performance resulting from the modifications.

U.S. Pat. No. 4,732,585 teaches a heat exchanger tube array with a plurality of horizontal plates between adjacent tubes in adjacent rows. The plates are oriented parallel to the flow of flue gases through the heat exchange region.

Another example of the use of baffle plates with heat exchanger tubes is disclosed in U.S. Pat. No. 5,318,109. In that patent, an elongated baffle plate is placed between pairs of adjacent tubes parallel with the gas flow for preventing the generation of what is termed multibank tubing compound resonance phenomenon.

In U.S. Pat. No. 4,226,279, attachments for heat exchange tubes are disclosed to suppress formation of standing waves of particles in the fluid moving through the heat exchanger. The attachments are horizontal plates which in some embodiments overlap the space between the tubes.

U.S. Pat. No. 3,476,180 teaches placement of a series of studs on the outside of a heat exchange tube in an attempt to increase the heat transfer per surface area of the tube. The studs, which each have a circular cross section and a wider base than top, are placed in multiple rows on slightly over one-half of the outer circumference of the tube surface. The studs are oriented toward the flow of flue gases.

U.S. Pat. No. 2,905,447 discloses a heat exchange tube having several triangular, waved fins attached to the outside of the tube. The fins are provided to assist with the heat exchange between the contents of the heat exchange tube and an external fluid medium by creating variations of direction, speed and pressure in the fluid medium circulating between the tubes.

In U.S. Pat. No. 4,691,766, heat exchangers having circular fins projecting from tubes are combined with an airfoil shaped assembly for dividing a fluid flowing through a heat exchanging region.

SUMMARY OF THE INVENTION

It is an object of the present invention to provide a novel, more cost effective and lower maintenance means to significantly reduce the surface erosion of boiler tubes, or banks of boiler tubes, caused by solid particles carried by hot combustion gases.

Accordingly, one aspect of the present invention is drawn to a deflector means that is attached to certain of the boiler tubes and that by being so attached preconditions the particle-laden combustion gas to reduce the number of particle-to-tube collisions. Such flow preconditioning is achieved by providing the deflector means with a trapezoidal cross section oriented so that the shortest of the parallel sides of the trapezoid is attached to the outer surface of the tube, which is oriented toward the direction of the oncoming flow of the particle-laden combustion gas. Being so oriented, the longer of the parallel sides of the trapezoid diverts the flow of the combustion gas and the particles entrained therein into the center of a channel that naturally occurs between two adjacent rows of tubes. The deflector means, which can be fabricated either from the same metallic material as the boiler tube or from a composite of two or more materials having a higher resistance to erosion than the boiler tube material, can be welded to new tubes at the time of manufacture or to tubes already in place and in use in an existing boiler. The deflector means is placed so that it runs parallel with the longitudinal axis of the tube. The deflector means may extend either fully or partially along the length of the tube, depending upon extent of the erosion pattern anticipated or observed from the combustion gas flow pattern.

Another aspect of the present invention is drawn to a means for markedly reducing the draft loss typically caused when combustion gases flow around boiler tubes or banks of boiler tubes. Such draft losses are known to cause certain inefficiencies in the operation of the boiler and associated equipment and to increase the costs of operating the same. The draft loss reduction means is employed along with the deflector means to offset and to further diminish such losses. The draft loss reduction means is placed upon the outer surface of a tube located immediately downstream of the tube having a deflector means attached to it. The draft loss reduction means preferably will have a rectangular cross section. Not unlike the deflector means, the draft loss reduction means will be composed of either the same material as the boiler tube or a highly erosion resistant composite material. The draft loss reduction means can be affixed to the tube in the same manner as the deflection means, and it also will be oriented parallel to the longitudinal axis of the tube.

The various features of novelty which characterize the invention are pointed out with particularity in the claims annexed to and forming a part of this disclosure. For a better understanding of the invention, its operating advantages and specific objects to be obtained by its use, reference is made to the accompanying drawings and descriptive matter in which a preferred embodiment of the invention is illustrated.

DESCRIPTION OF THE PREFERRED EMBODIMENT

Figure 1:
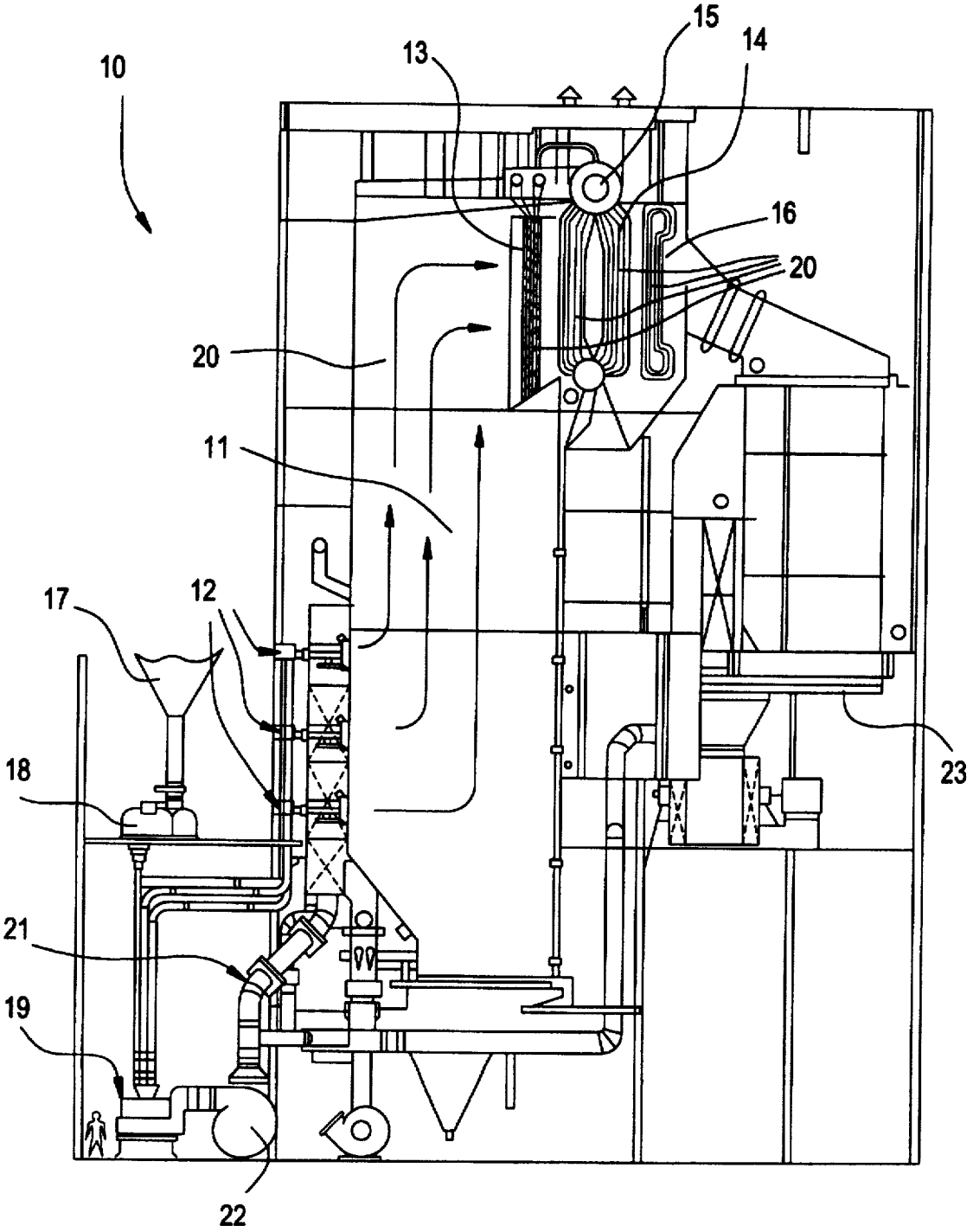
FIG. 1 is a side elevational view, partly in cross section, of a known fossil fuel-fired boiler in which the present invention may be employed.
Figure 2A:
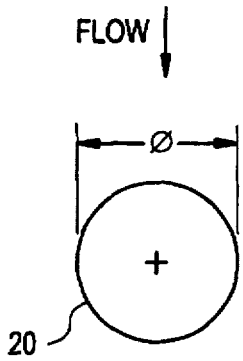
FIG. 2 provides various cross sectional schematic views of boiler tubes, wherein: view (a) depicts a bare tube of the type commonly employed in a boiler; view (b) shows a deflector means of the present invention attached to the tube of view (a), the deflector means having a trapezoidal cross section wherein the height of the trapezoid is approximately equal to the outside diameter of the tube and wherein the shorter of the parallel sides of the trapezoid faces into the oncoming flow of combustion gas and has a length equivalent to one-fourth of the trapezoid's height; view (c) illustrates a deflector means of the present invention fastened to a tube, the deflector means having a trapezoidal cross section wherein the height of the trapezoid and the length of the longer of the parallel sides of the trapezoid are approximately equal to the outside diameter of the tube and wherein the longer of the parallel sides of the trapezoid faces into the oncoming gas flow; view (d) shows a deflector means which is similar to that depicted by view (c), except the height of the trapezoidal cross section is approximately equal to one-half the outside diameter of the tube; view (e) depicts a draft loss reduction means attached to a boiler tube, the draft loss reduction means having a square cross section wherein the length of the sides of the square are approximately equal to one-fourth the outside diameter of the tube and being positioned on the tube so that it is directed into the flow of the combustion gas; view (f) shows a preferred embodiment of the present invention wherein the deflector means and tube of view (d) and the draft loss reduction means and tube of view (e) are arranged in adjacent rows of a tube bank such that the tube having the deflector means is in the outermost row of tubes and is directly exposed to the oncoming flow of combustion gas and the tube having the draft loss reduction means is in the next row of the tube bank, immediately downstream of tube having the deflector means.
Figure 2B:
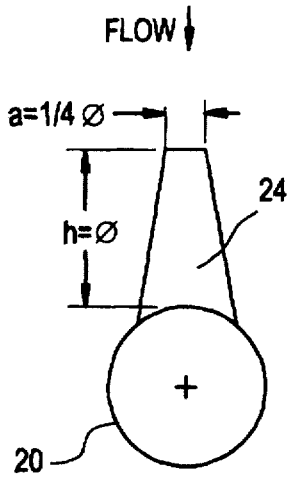
Figure 2C:
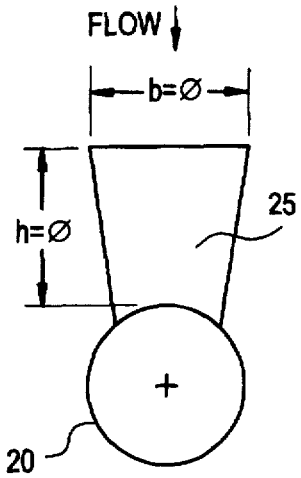
Figure 2D:
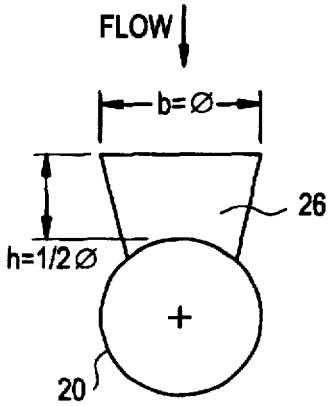
Figure 2E:
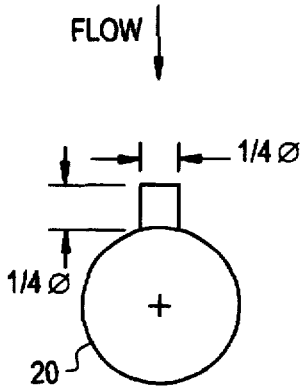
Figure 2F:
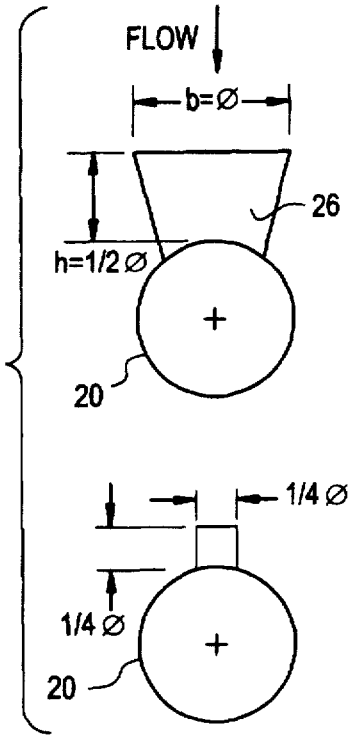

Referring to the drawings, wherein like numerals represent the same or similar elements throughout the several drawings, FIG. 1 shows a known fossil fuel-fired boiler, generally designated by the numeral 10, in which the present invention may be employed. Boiler 10 generally is comprised of a box-like furnace portion 11, a plurality of burners 12 which are affixed to a side of the furnace 11 at its lower half, a superheater apparatus 13, a boiler bank apparatus 14, a steam drum 15 and an economizer apparatus 16. The superheater 13, boiler bank 14, and economizer 16 are situated at the top of furnace 11 and generally are comprised of a plurality of heat exchange tubes 20 which transport water and/or steam to or from steam drum 15 which also is situated at the top of furnace 11. Heat exchange tubes 20 also line the inside of the walls of furnace 11.

In operation, raw coal from a coal bunker 17 is transported to a coal feeder 18 and then to a pulverizer 19, wherein the raw coal is ground to a fine powder. The finely ground coal powder is thereafter transported to the burners 12 where it is combined with combustion air which is transported to the burners 12 through a primary air duct 21 from primary air fan 22. In the burners 12, the coal and air are mixed, possibly with one or more other fossil fuels, and combustion occurs. Hot combustion gas carrying particulate matter flows from the burners 12 into furnace 11 and then rises upward toward and flows through the superheater 13, the boiler bank 14 and the economizer 16. After passing the economizer 16, the combustion gas further passes through the boiler 10 to a gas outlet 23.

Of particular interest in the case of the present invention is the flow of the combustion gas through that portion of the boiler 10 where the superheater 13, the boiler bank 14 and the economizer 16 are situated. In that locale, the combustion gas and the solid particulate matter entrained therein approach the superheater 13, the boiler bank 14 and the economizer 16 in a path that is generally perpendicular to the heat exchange tubes 20 which comprise each apparatus.

FIG. 2(*a*) shows one of such heat exchange tubes 20 as it would be situated in a first row of the superheater 13, the boiler bank 14 or the economizer 16. As shown in FIG. 2(*a*), tube 20 has an outer diameter designated $\phi$. The direction of the oncoming combustion gas is denoted by the arrow in FIG. 2(*a*). As the gas flows around tube 20 a portion of the particulate matter it carries collides with the exposed outer surface of tube 20 and erosion occurs. After the gas completes its flow past tube 20, it encounters additional tubes (not shown) which are like tube 20 and are situated in one or more rows down stream of tube 20. Any particles remaining in the gas may collide with the exposed outer surface of the downstream tubes and erosion of such tubes can result.

FIG. 2(*b*) shows a deflector means 24 attached to a tube 20. The deflector means 24 has a trapezoidal cross section wherein the height, h, of the trapezoid is approximately equal to outside diameter, $\phi$, of tube 20 and the shorter of the parallel sides of the trapezoid faces into the oncoming flow of the combustion gas and has a length, a, which is equivalent to one-fourth of the trapezoid's height, or ¼ h. It is envisioned that deflector means 24 would avoid erosion of tube 20 by forcing some of the particulate matter contained in the gas to collide with the exposed faces of deflector 24 instead of the tube 20 and by diverting the remainder of the particulate matter away from tube 20.

FIG. 2(*c*) illustrates yet another deflector means 25 fastened to tube 20. The deflector means 25 has a trapezoidal cross section wherein the height, h, of the trapezoid and the length, b, of the longer of the parallel sides are approximately equal to the outside diameter, $\phi$, of tube 20. Additionally, the longer of the parallel sides of the trapezoid faces directly into the oncoming gas flow. By orienting deflector means 25 as shown, it is envisioned that erosion of tube 20 is avoided by causing a portion of the particles in the gas to strike the exposed face of the deflector 25 instead of the tube 20 and by directing the remaining particles flowing within the gas away from the tube 20.

A view of deflector means 26 attached to tube 20 is provided in FIG. 2(*d*). Deflector means 26 is similar to deflector means 25, except that the height, h, of deflector 26 is equal to approximately one-half the outside diameter, $\phi$, of the tube 20. It is envisioned that deflector means 26 generally will function to avoid erosion in the same manner as deflector means 25.

FIG. 2(*e*) shows a view of a draft loss reduction means 27 attached to tube 20. Preferably, draft loss reduction means 27 will have a generally square cross section wherein the length of the sides of the square are approximately equal to one-fourth the outside diameter of tube 20, i.e., ¼$\phi$. Draft loss reduction means 27 also will be positioned on tube 20 so that it is directed into the flow of the combustion gas.

In the preferred embodiment of the invention, the deflector means 26 and tube 20 of FIG. 2(*d*) will be used in concert with the draft loss reduction means 27 and tube 20 of FIG. 2(*e*). FIG. 2(*f*) shows the preferred arrangement of tubes 20 having deflector means 26 and draft loss reduction means 27 attached. In such an arrangement, which may be utilized in the superheater 13, the boiler bank 14 and/or the economizer 16, tube 20 having the deflector means 26 will be situated in a first and outermost tube row of a tube bank so that it will be exposed directly to the oncoming flow of combustion gas and tube 20 having draft loss reduction means 27 will be located in the next row of the tube bank, immediately down stream of the tube 20 having the deflector means 26. Deflector means 26 and draft loss reduction means 27 are placed upon their respective tubes 20 so that they each run parallel with the tube's longitudinal axis. The deflector means 26 and the draft loss reduction means 27 may extend either fully or partially along the length of tubes 20, depending upon the extent of the erosion pattern expected or found from the combustion gas flow pattern.

Figure 3:
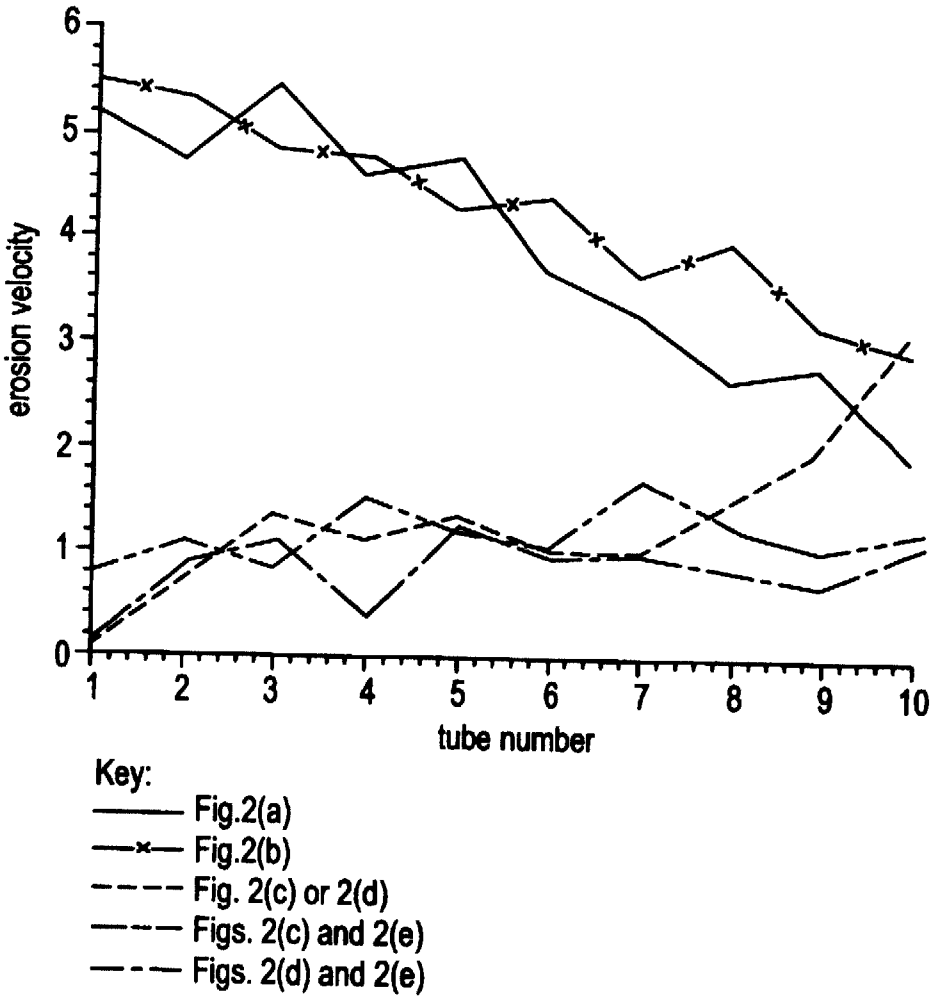
FIG. 3 is a graphical illustration of erosion velocity of tubes in a tube bank, determined by numerical analysis for selected tube geometries shown in FIGS. 2(*a*) through 2(*f*).
Figure 4:
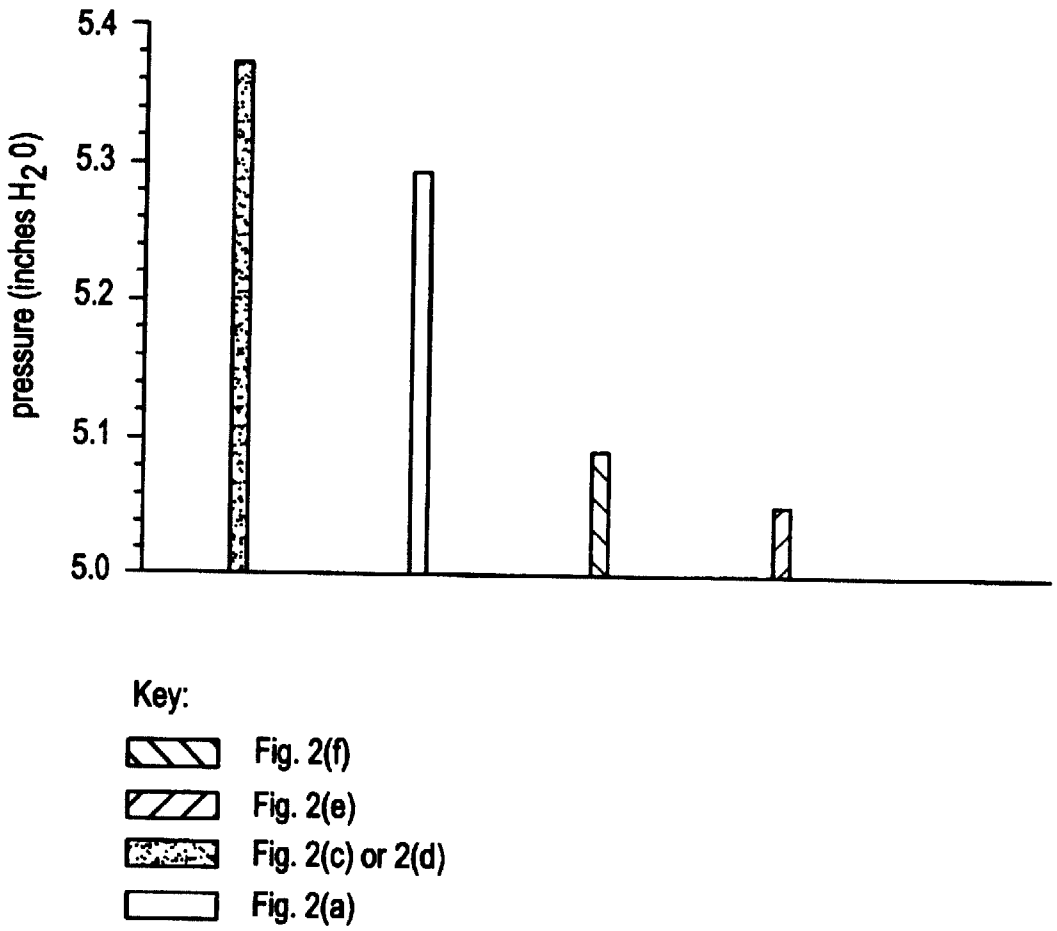
FIG. 4 is a graphical representation of tube bank draft loss values determined analytically for certain of the tube geometries depicted in FIGS. 2(*a*) through 2(*f*).

FIG. 3 and FIG. 4 provide insight into how and why the specific deflector means 26 of FIG. 2(*d*) was selected for use with the draft loss reduction means of FIG. 2(*e*). FIG. 3 is a graphic presentation of erosion velocity of tubes 20 in a tube bank having ten rows of tubes. Erosion velocity, determined by numerical analysis, is plotted for bare tube 20 (FIG. 2(*a*)), tube 20 with deflector means 24 (FIG. 2(*b*)), tube 20 with deflector means 25 or deflector means 26 (FIG. 2(*c*) or 2(*d*)), tube 20 with deflector means 25 in arrangement with tube 20 having draft loss reduction means 27 (FIGS. 2(*c*) and (*e*)), and tube 20 with deflector means 26 in arrangement with tube 20 having draft loss reduction means 27 (FIGS. 2(*d*) and (*e*), or alternatively, FIG. 2(*f*)). FIG. 3 shows that deflector means 25 of FIG. 2(*b*) increases the erosion velocity above that of the bare tube 20. It is believed that this increase is due to the shape of deflector means 25, which allows particulate to be directed toward the second row of tubes and which introduces a significant amount of turbulent energy causing the particles to not coalesce between the tube rows. The erosion velocity of the bare tube 20 and the tube having deflector means 25 reduces as the gas flow progresses through the tube bank. This reduction is believed to be the result of the particles becoming aligned with the gap between the sections of tubes. The tubes having deflector means 26 or deflector means 27 (FIGS. 2(*c*) or (*d*)) exhibit a relatively low level of erosion throughout all tube rows. This lower level is believed to be the result of a pre-conditioning prior to the gas flow entering the tube bank. The arrangements of deflector means 25 or deflector means 26 with draft loss reduction means 27 (FIGS. 2(*c*) and (*e*) or FIGS. 2 (*d*) and (*e*)) provide a lower level of erosion than either of the deflector means 25 or 26 alone. It is believed that the arrangement of deflector means 26 with draft loss reduction means 27 (the preferred embodiment of the invention) will result in the lowest overall erosion velocity.

FIG. 4 provides a graphic demonstration of draft loss for bare tube 20 (FIG. 2(*a*)), tube 20 with deflector means 25 or deflector means 26 (FIGS. 2(*c*) or (*d*)), tube 20 with draft loss reduction means 27 (FIG. 2(*e*)), and tube 20 with deflector means 26 in arrangement with tube 20 having draft loss reduction means 27 (FIGS. 2(*d*) and (*e*), or alternatively FIG. 2(*f*)). FIG. 4 indicates that use of the preferred embodiment of the invention would reduce the draft loss across a tube bank to a level that is below that experienced for a bank having bare tubes. FIG. 4 further indicates that use of deflector means 25 or deflector means 26 without draft loss reduction means 27 would create a small increase in draft loss across a bank of bare tubes.

While a specific embodiment of the invention has been shown and described in detail to illustrate the application of the principle of the invention, it will be understood by those skilled in the art that the invention may be embodied otherwise without departing from such principles.

What is claimed is:

1. A heat exchanger tube bank for removing heat from a flowing, particle-laden combustion gas produced in a fossil fuel-fired boiler, the tube bank having a plurality of heat exchange tubes arranged in a plurality of rows that extend across the path of the combustion gas, the tube bank being comprised of:

a first row of heat exchange tubes with each tube in said row having a bar-like means for deflecting the combustion gas away from the tube, the deflecting means being rigidly attached to the outer surface of the tube and extending parallel to a central longitudinal axis of the tube and having a trapezoidal cross section, the longer of the parallel sides of which cross section is oriented squarely toward the path of the combustion gas; and a second row of heat exchange tubes, situated immediately downstream of the first row of tubes, with each tube in the second row having a bar-like means for reducing a draft loss, the draft loss reducing means being rigidly attached to the outer surface of the tube and extending parallel to a central longitudinal axis of the tube and having a square cross section oriented so that a first side of the cross section is tangent to the outer surface of the tube and a second side of the cross section, which is parallel to the first side, faces the first row of tubes.

2. The heat exchanger apparatus according to claim 1, wherein the height of the trapezoidal cross section of the deflector means is approximately equal to one-half the outside diameter of the heat exchange tube and the length of the longer of the parallel sides of the trapezoidal cross section is approximately equal to the outside diameter of the heat exchange tube.

3. The heat exchanger apparatus according to claim 2, wherein the length of the sides of the square cross section of the draft loss reduction means is approximately equal to one-fourth the outside diameter of the heat exchange tube.

4. A heat exchange tube arrangement for reducing erosion and draft loss in a heat exchanger apparatus used to remove heat from a flowing, particle-laden combustion gas produced in fossil fuel-fired boiler, the arrangement being comprised of:

a first plurality of heat exchange tubes aligned in a first row with each tube in said row having a bar-like means for deflecting the combustion gas away from the tube, the deflecting means being rigidly attached to the outer surface of the tube and extending parallel to a central longitudinal axis of the tube and having a trapezoidal cross section, the longer of the parallel side of which cross section is oriented squarely toward the path of the combustion gas;

a second plurality of heat exchange tubes aligned in a second row situated immediately downstream of the first row, with each tube in the second row having a bar-like means for reducing a draft loss, the draft loss reducing means being rigidly attached to the outer surface of the tube and extending parallel to a central longitudinal axis of the tube and having a square cross section oriented so that a first side of the cross section is tangent to the outer surface of the tube and a second side of the cross section, which is parallel to the first side, faces the first row of tubes.

5. The heat exchange tube arrangement of claim 4, wherein the height of the trapezoidal cross section of the deflector means is approximately equal to one-half the outside diameter of the heat exchange tube and the length of the longer of the parallel sides of the trapezoidal cross section is approximately equal to the heat exchange tube.

6. The heat exchange tube arrangement of claim 5, wherein the length of the sides of the square cross section of the draft loss reduction means is approximately equal to one-fourth the outside diameter of the heat exchange tube.

* * * * *